US005462241A

United States Patent [19]

Howden, Jr.

[11] Patent Number: 5,462,241

[45] Date of Patent: Oct. 31, 1995

[54] RUG WINDING APPARATUS

[76] Inventor: Dwight E. Howden, Jr., 2029 Brookview Dr., Dalton, Ga. 30720

[21] Appl. No.: 315,226

[22] Filed: Sep. 29, 1994

[51] Int. Cl.[6] ..... B65H 18/10; B65H 19/30

[52] U.S. Cl. ..... 242/533.7; 242/532.6; 242/535.4; 242/598.1

[58] Field of Search ..... 242/533.7, 532.6, 242/535.4, 598.1

[56] References Cited

U.S. PATENT DOCUMENTS

| | | | |
|---|---|---|---|
| 2,202,563 | 5/1940 | Mikaelson | 242/533.7 |
| 2,911,164 | 11/1959 | Caine | 242/533.7 |
| 3,729,102 | 4/1973 | Shumaker | 242/533.7 X |
| 4,099,682 | 7/1978 | Benuska | 242/533.7 X |
| 4,334,651 | 6/1982 | McKinnon | 242/532.6 X |
| 4,669,247 | 6/1987 | Woffindin | 242/533.7 X |
| 4,695,005 | 9/1987 | Gietman | 242/533.7 X |
| 4,844,369 | 7/1989 | Kanayachi | 242/532.6 X |

*Primary Examiner*—John M. Jillions
*Attorney, Agent, or Firm*—Alan Ruderman

[57] ABSTRACT

A method and apparatus for winding a rug into a roll about a mandrel and thereafter pushing the roll off the mandrel. The mandrel is driven at one end and the web is discharged from the opposite end. An end support member is provided at the discharge end prior to and while the mandrel is being rotatably driven which together with bearings at the driven end of the mandrel provide support for the mandrel. The end support member is removed after the rug is wound so that the rug may be discharged from the mandrel. A support carriage beneath the mandrel is raised prior to removal of the end support member to support the roll and thus the mandrel. A pusher plate having a bushing disposed about the mandrel not only pushes the roll off the mandrel but supports the mandrel as it moves toward the discharge end. As the pusher approaches the support cradle, the cradle is lowered.

22 Claims, 4 Drawing Sheets

RUG WINDING APPARATUS

BACKGROUND OF THE INVENTION

This invention relates to a method and apparatus for winding a web material into a tight roll and more particularly to a method and apparatus for winding a rug about a mandrel driven from one end and discharging the rug from the opposite end of the mandrel while supporting the mandrel not only when the rug is being wound, but also while it is being discharged.

In the carpet and rug manufacturing art, the finished product is generally wound into a roll. Broadloom carpet, because it is generally 12 to 15 feet wide is wound about a paperboard core to preclude bending of the roll, the core remaining with the roll of carpet. Rugs, however, because of their shorter widths, which generally are in the range of 6 to 9 feet, are wound by hand about itself. That is, an initial coil is formed and the rug is rolled by hand about the initial coil so that the outer layers are wrapped about the inner layers from the outside. Thus, the wound rug generally is loose and the edges of the roll are uneven. This, of course, makes it extremely difficult to place wrapping material about the rug roll and increases the overall process time.

It is known in certain arts to wind a roll of web material about a mandrel and thereafter to push the roll off the mandrel. For example, in Benuska U.S. Pat. No. 4,099,682, a web of asphalt material is wound about a mandrel and thereafter pushed off the mandrel by a pusher plate. One problem that is presented with such a construction occurs when the mandrel is driven from one end and is pushed off the opposite end. In order to support the mandrel at both ends while it is rotating and thus during winding, Benuska at the end opposite the driven end provides an end support member which supports the mandrel during the rotation and thereafter pivots away from the end for permitting the roll to be pushed off. Thus, although the mandrel is rotatably supported while the roll is being wound, the bearings at the driven end have a large bending load applied after the end support member is removed from the opposite end. Woffendin U.S. Pat. No. 4,669,247, discloses an apparatus in which the end of the mandrel from which the roll is ejected is mounted in split bearings carried in swing doors, but again when a roll is ejected no support for the bearings at the opposite end is provided. In McKinnon U.S. Pat. No. 4,334,651 a roofing material roll winder is disclosed having an ejector for pushing a roll off a mandrel, but the mandrel does not have outboard bearings.

It is evident that the bearings at the driven end of the mandrel will be short lived unless some means for supporting the mandrel is provided to prevent a cantilevered effect at the driven end and thus to alleviate bending loads on the bearings at the driven end while a roll is being pushed off the end of the end of the mandrel opposite the driven end.

SUMMARY OF THE INVENTION

Consequently, it is a primary object of the present invention to provide a method and apparatus for winding web material into a roll about a mandrel rotatably driven at one end with the roll being discharged from the opposite end and wherein support is provided for the mandrel and thus the bearings at the driven end not only while the mandrel is rotated, but also while the roll is being discharged.

It is another object of the present invention to provide a method and apparatus for winding web material into a roll about a mandrel rotatably driven at one end and having the roll discharged from the opposite end, wherein not only is the mandrel supported at both ends while the web is being wound so that the forces on the bearings supporting the mandrel at the driven end are minimized, but also wherein the mandrel is supported intermediate the ends while the roll is being discharged from the mandrel.

It is a further object of the present invention to provide a method and apparatus for winding a rug into a roll about a mandrel and thereafter pushing the rug off the mandrel, the mandrel being rotatably driven at a first end and the roll being discharged from a second end opposite the first end, the second end of the mandrel being rotatably supported prior to and while the mandrel is rotating and being supported by additional support means adjacent the second end while the roll is being discharged so that the first end is precluded from becoming cantilevered.

It is a still further object of the present invention to provide a method and apparatus for winding a rug into a roll about a mandrel and thereafter pushing the rug off the mandrel by a pushing member, the mandrel being rotatably driven at a first end and the roll being discharged from a second end opposite the first end, the second end of the mandrel being rotatably supported prior to and while the mandrel is rotating and being supported by a support member adjacent the second end which engages the roll until the pusher member approaches the second end, and thereafter is supported by the pusher member while the roll is being completely discharged from the mandrel.

Accordingly, the present invention provides a method and apparatus for winding a web of material such as a rug into a roll about a mandrel and thereafter pushing the roll off the mandrel, the mandrel being driven at one end and the web being discharged from the opposite end, and the mandrel being supported prior to and while the web is wound and additionally while the roll is being discharged. An end support member is provided at the roll discharge end of the mandrel prior to and while the mandrel is being rotatably driven, the end support member includes bearing means which together with the bearings at the driven end of the mandrel provide support for the rotational and bending forces on the mandrel. After winding is complete, the end support member is removed so as not to interfere with the discharge of the roll from the mandrel. In order to ensure that the mandrel is always supported so that the loads on the bearings at the driven end of the mandrel are not excessive, support means are provided adjacent the discharge end after rotation of the mandrel has ceased and prior to the end support member being removed. To this end, a cradle support beneath the mandrel adjacent the discharge end is raised to support the roll. The end support member is then removed and a pusher member is actuated to push the roll toward and off the discharge end. The pusher member is disposed about the mandrel and carries a bushing to support the mandrel as it moves from the driven end toward the discharge end. Just prior to the pusher member reaching the position of the support cradle, the support cradle is removed from the roll and the pusher member supports the mandrel until the roll has been completely discharged. The end support member thereafter returns to the supporting position and the pusher member then returns to its initial position adjacent the driven end of the mandrel.

Pneumatic cylinders activated in response to sensors actuate the end support member, the support cradle and the pusher member so that the end support member is not removed from its mandrel supporting position until the cradle has been activated to support the roll, and the pusher member is not engaged until the support cradle is in its supporting position, and so that the support cradle returns to its initial position when the pusher member approaches the support cradle and so that the end support member returns to the mandrel supporting position when the pusher member reaches the end of the mandrel.

In the preferred form of the invention, the end support member includes a bearing plug which is inserted into the discharge end of the mandrel in its operative position and is pivotably rotated away from the mandrel to the inoperative position. The support carriage preferably includes a rotatable roller having an axis of rotation below and transverse to the axis of the mandrel and permits a wound roll to readily ride thereon as it is being discharged. Additionally, in the preferred form of the invention the pusher member includes a disk carrying a bushing journalled about the mandrel for relative movement therewith.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
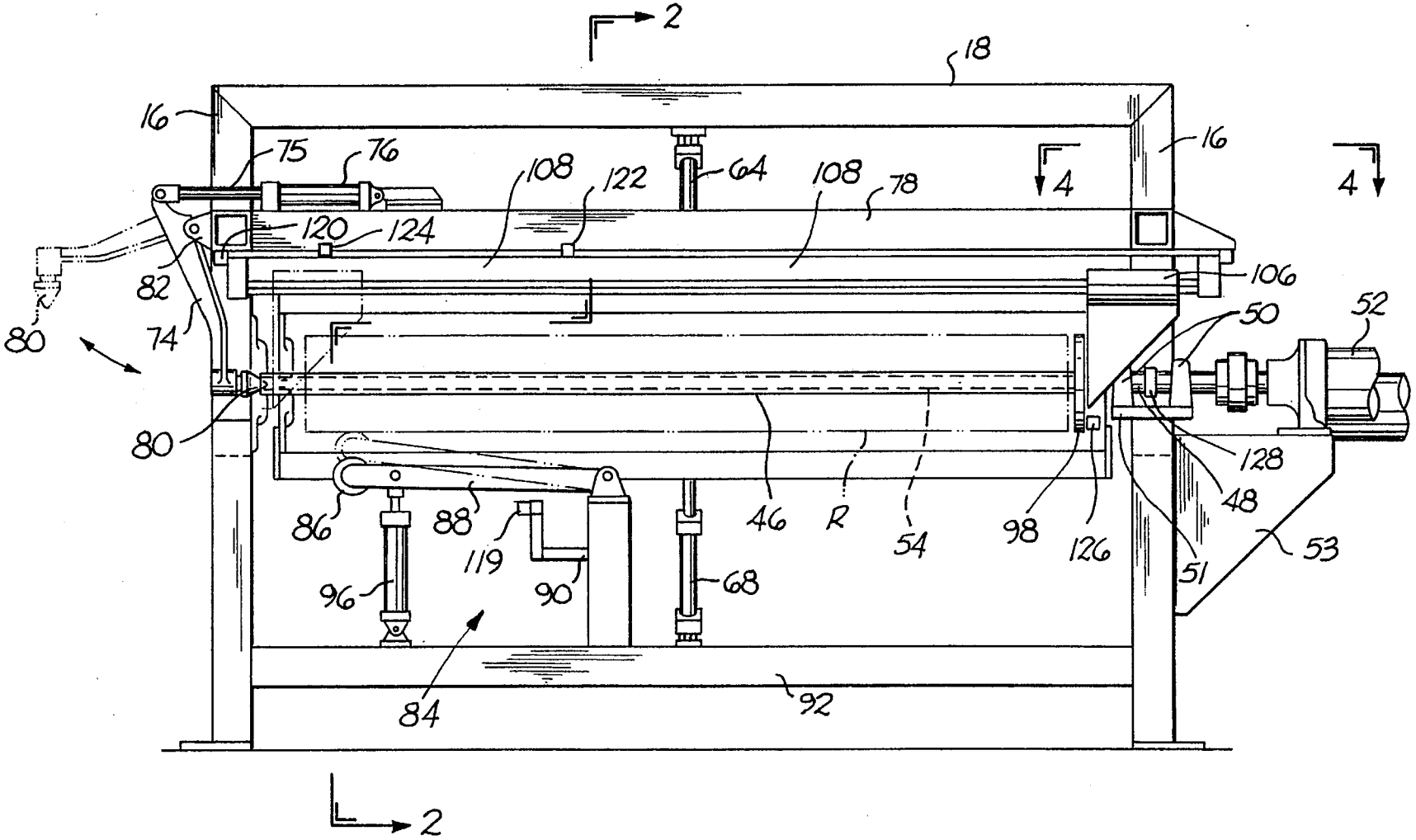
FIG. 1 is a rear or head end elevational view of rug winding apparatus incorporating the principles of the present invention.

Referring to the drawings, web winding apparatus according to the present invention is illustrated as applied to a rug winding machine 10 which includes a web conveyor table 12 on which a rug may be placed, the table extending from an entry or a tail end to a discharge or head end of the machine. The table is spaced above the floor and includes a frame having side rails 14 which extend from the entry end to an upstanding standard 16 adjacent the discharge end, the standard extending vertically from the floor at each side and having a transversely extending beam 18 secured at each side. The conveyor table 12 includes a plurality of side-by-side conveyor belts 20 trained about a head end roller 21 at the head or rear of the conveyor and a tail end roller 22 at the entry end of the conveyor, and about a drive roller 23 and a take-up roller 24. A chain 25 is trained about a sprocket 26 mounted on one end of the shaft on which the drive roller 23 is mounted and about an idler sprocket 28, and additionally about a sprocket 30 mounted adjacent one end of a shaft 32 on which a bottom nip roll 34 is mounted. The shaft 32 is journally mounted in the upstanding standards 16 and a drive motor 36 is secured to the end of the shaft 32 for rotatably driving the shaft 32 and thus the conveyor and the nip roll 34. Intermediate the motor 36 and the sprocket 30, a gear 38 is secured on the shaft 32 and is in operative meshing engagement with another gear 40 mounted on the end of another shaft 42, an upper nip roll 44 being mounted on the shaft 42. Preferably the upper nip roll 44 floats relative to the lower roll 34 within the confines of the meshing teeth of the gears 38 and 40 so that a rug conveyed by the conveyor may enter the nip between the rolls 34, 44 and be fed thereby to the head end of the machine.

Spaced rearwardly of the nip rolls 34, 44 and extending axially parallel thereto is a hollow mandrel 46. One end of the mandrel 46, i.e., the driven end, is coupled to one end of a stub shaft 48 which is supported by a pair of pillow bearings 50 carried on a bracket 51 fastened to the adjacent standard 16, the other end of the stub shaft being coupled to a motor/reducer combination 52 carried on a bracket 53 fastened to the standard 16. The mandrel 46 has an axially elongated slot in the periphery thereof for receiving the leading edge of the rug web fed to it by the nip rolls 34, 44.

In order to accurately direct the leading edge of the web into the slot 54, there is provided a pair of movable guide members in the form of upper and lower transversely extending plates 56, 58 respectively. The ends of the upper plate member 56 are fastened to a pair of arms 60, 61 at respective ends of the apparatus and the arms 60, 61 are journally mounted on the shaft 42 on which the upper nip roll 44 is mounted. Similarly, the ends of the lower plate member 58 are secured to a pair of arms 62, 63 which are journally mounted at respective ends of the shaft 32 on which the lower nip roll 34 is mounted. One end of a pneumatic cylinder 64 is pivotably attached to the beam 18 and the other end is pivotably attached to an arm 66 adjacent the leading edge of the plate 56 remote from the shaft 42, while one end of another pneumatic cylinder 68 is pivotably attached to the lower beam 70 spanning the standard 16 and the other end of the cylinder 68 is pivotably attached to an arm 72 adjacent the leading edge of the plate 58 remote from the shaft 62. When the cylinders are actuated, the plates may be moved into an operative guiding position wherein the leading edges form a narrow triangular shaped channel between the plates and adjacent the mandrel for directing the leading edge of the web into the slot 54. When the cylinders are deactivated the plates 56, 58 are removed away from the mandrel so as not to interfere with the winding and ejection of the web.

Figure 5:
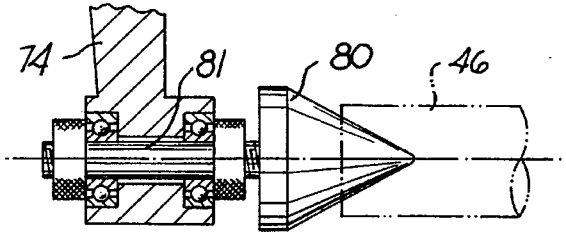
FIG. 5 is a fragmentary sectional view of a portion of the removable mandrel end support member.
Figure 6:
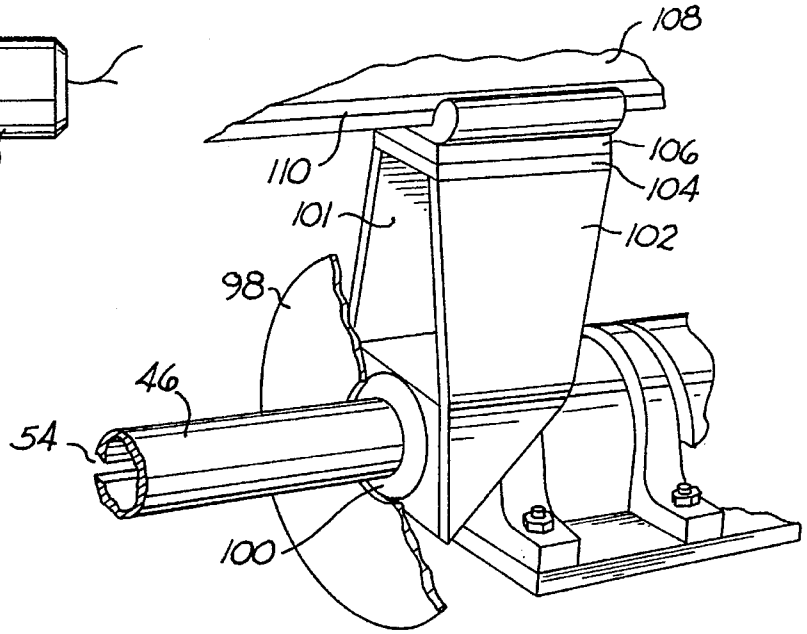
FIG. 6 is a perspective view of the pusher plate and mandrel support bearing, with portions thereof broken away.
Figure 4:
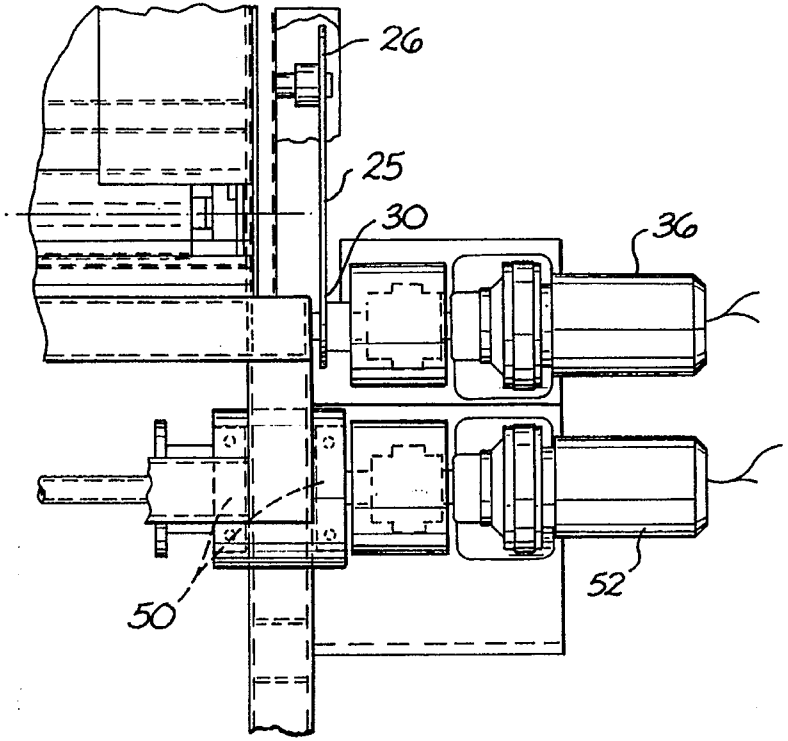
FIG. 4 is a partial top plan view of a portion of the apparatus illustrating the drive members.

In order to support the mandrel 46 at the end opposite the driven end, there is provided a support arm in the form of a lever 74. The arm is pivotably connected at one end to the end of a piston rod 75 of a pneumatic cylinder 76, the opposite end of the cylinder 76 being connected to a block fixed to a beam 78 which extends rearwardly from the standards 16. The other end of the arm 74 carries a conically shaped plug 80, the plug, as illustrated in FIG. 5, being threadedly secured on the end of a small shaft 81 which is rotatably journalled in the end of the arm 74 and precluded from translational movement relative thereto by conventional means secured to the shaft 81. The plug 80 is of a size such that the apex and adjacent portion thereof is received into the end of the mandrel with a portion of the interior wall of the mandrel securely abutting the plug. The arm 74 intermediate its ends is pivotably journalled on a bracket 82 secured to the beam 78, the pivot axis being in a vertical plane substantially perpendicular to the axis of the mandrel 46. When the cylinder 76 is actuated the arm 74 pivots counterclockwise as viewed in FIG. 1 and the plug enters the end of the mandrel so that the arm 74 may support the end of the mandrel remote from the driven end. Thus, when a web is being wound into a roll R and the mandrel is being rotatably driven, the mandrel is supported at both ends. When a roll has been wound and is to be discharged, the arm is pivoted clockwise as viewed in FIG. 1 to remove the plug from the end of the mandrel and out of the path of the roll so that the roll may be discharged from that end of the mandrel.

In order to ensure that the mandrel is supported while the arm 74 is in the roll discharge position, the present invention provides a roll support cradle 84 comprising a roller 86 pivotably carried between the end of a pair of lever arms 87, 88, the arms 87, 88 being pivotably journalled at a location spaced from the roller 86 on a bracket 90 upstanding from a beam 92 secured between the standards 16. Intermediate the arms 87, 88 is the end of a rod 94 of a pneumatic cylinder 96. The roller 86 may be rotated about a pivot axis in a vertical plane substantially perpendicular to the axis of the mandrel. When a roll of wound rug R is to be discharged from the end of the mandrel, the cylinder 96 is actuated to engage the roller 86 against the surface of the roll R of wound rug to support the roll and the mandrel, and thereafter the arm 74 is pivoted from the end supporting position to the roll discharge position. Thus, the mandrel remains supported at the discharge end after the end support has been removed by the arm 74. The roller 86 is disposed so that as the wound roll is discharged, it may ride on and rotate the roller so that the roller supports but does not interfere with the discharging of the roll.

In order to discharge a roll R from the mandrel after it has been wound, the present invention provides an ejector or pusher in the form of an annular disk 98 disposed about the mandrel 46. The central portion of the disk at the face disposed toward the driven end of the mandrel is fastened to a cylindrical bushing 100 slidably journalled on the mandrel 46 and within which the mandrel may rotate. Additionally, that same surface of the disk is secured to a small housing in the form of a pair of spaced apart legs 101, 102 which extend upwardly and are bridged by a plate 104. The plate 104 is fastened to the slide member 106 of a conventional pneumatic band cylinder 108, such as manufactured by Tol-0-matic of Minneapolis, Minn., the slide member 106 riding in a slideway 110 of the band cylinder. The band cylinder is carried by the beam 78 and extends across the machine between the standards 16. When the band cylinder is actuated by application of pneumatic pressure, a piston within the cylinder is driven and pushes the slide member 106 along the outer housing of the band cylinder from the driven end of the mandrel to the opposite end. This results in the pusher disk 98 being driven along the mandrel 46 to abut the end of a rug wound as a roll thereon. As this occurs, the bushing 100 slides along the mandrel and the weight of the mandrel is supported by the pusher system.

Accordingly, when the wound roll R is to be discharged, the support cradle 84 is activated to support the wound roll and the end support arm 74 is withdrawn away from the end of the mandrel. Thereafter the pusher system band cylinder 108 is actuated so that the pusher disk 98 pushes the wound roll off the mandrel, the bushing together with the disk, the arms 101, 102 and the band cylinder components aid in supporting the mandrel. When the disc approaches the vicinity of the support cradle 84, the support cradle cylinder 96 is deactuated and the roller 86 is withdrawn beneath the discharging roll. At that time the pusher system supports the mandrel as it moves along the mandrel to the discharging end. After the wound roll has been discharged from the end of the mandrel, the end support cylinder 76 is actuated to reinsert the plug 80 into the end of the mandrel so that the support arm 74 supports the mandrel at that end. The pusher system band cylinder 108 then is deactivated to drive the pusher disc to its home position at the driven end of the mandrel.

Figure 2:
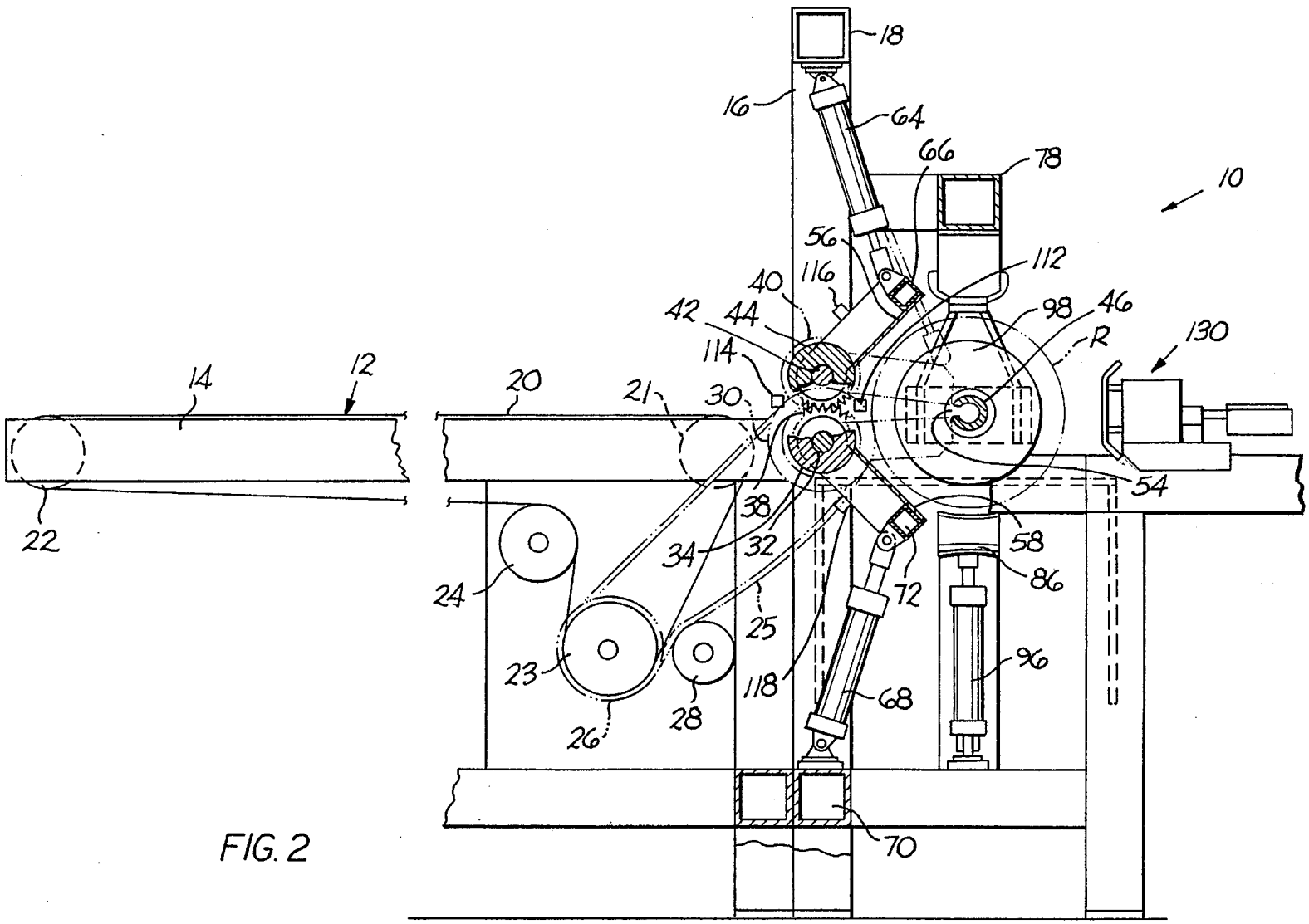
FIG. 2 is a sectional view taken substantially along line 2—2 of FIG. 1.
Figure 3:
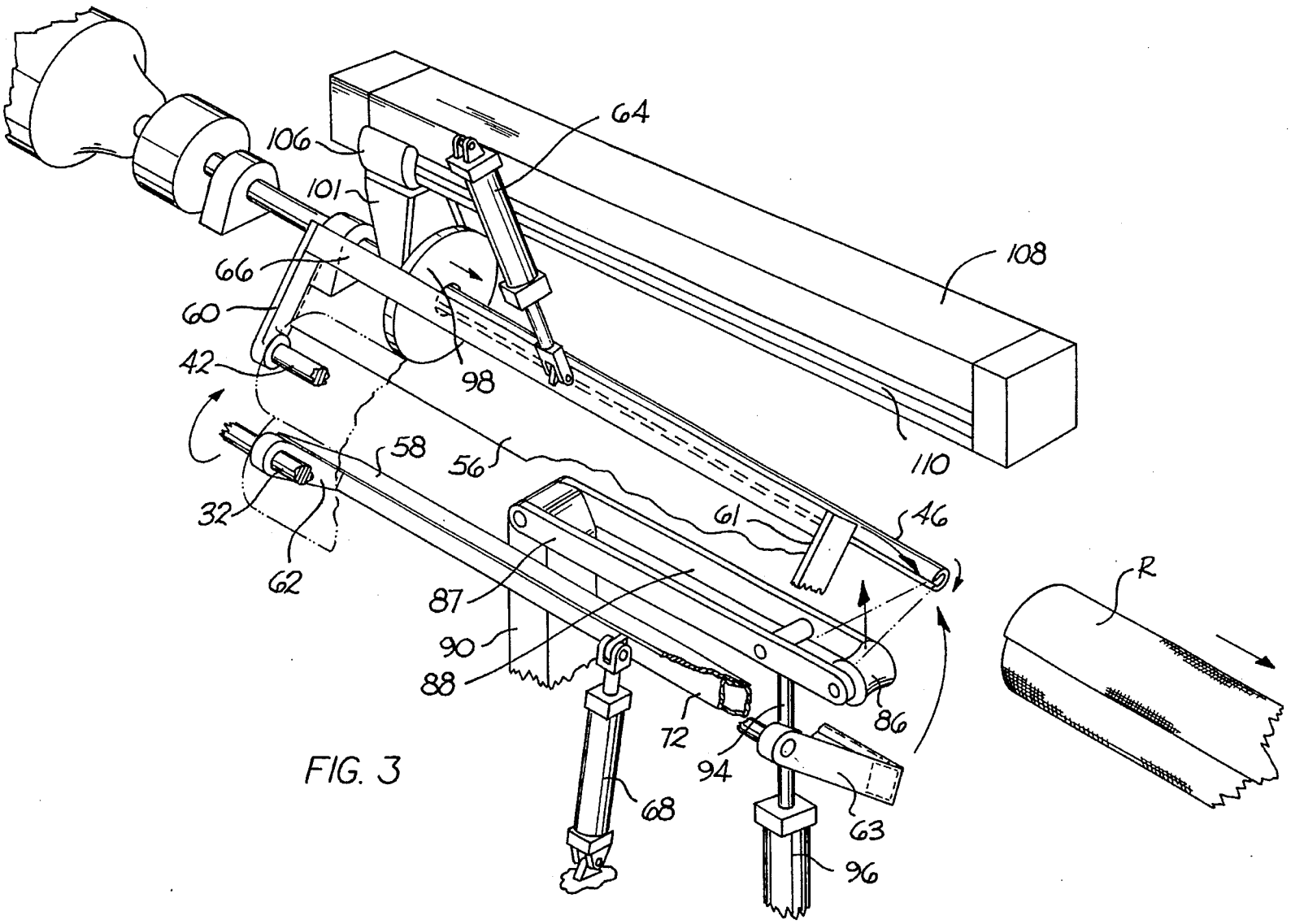
FIG. 3 is a fragmentary front perspective view illustrating portions of the apparatus shown in FIG. 1.

Series of magnetic proximity switches and photoelectric sensors mounted in operative positions on the frame of the machine are provided for aiding and controlling the sequencing of the apparatus. For example, a leading edge photoelectric sensor 112 senses the leading edge of the rug, starts a timer, and after a pre-set time the leading edge of the rug is received into the mandrel slot 54 and the mandrel drive motor 52 commences its rotation to wind the rug about the mandrel. The direction of rotation of the mandrel is dependent upon whether a "face-out" winding of the rug is desired or a "face-in." If face-out has been selected, the mandrel 46 will rotate clockwise as viewed in FIG. 2 and the lower guide plate cylinder 68 will deactivate lowering the guide plate 58 to the fully opened position. The upper guide plate cylinder 64 will remain actuated to thereby allow the guide plate 56 to follow the roll R as it grows in diameter. If face-in has been selected, the mandrel 46 will rotate counter-clockwise as viewed in FIG. 2 and the guide plate cylinder 64 will deactivate, thereby raising the upper guide plate 56 to the fully opened position, while the lower guide plate cylinder 68 remains actuated to allow the guide plate 58 to follow the roll R as it grows in diameter. A trailing edge photoelectric sensor 114 senses the time the rug was under the sensor to thereby measure the time and thus the length of the rug, this being a direct relationship to the diameter of the roll R. As the trailing edge clears the sensor 114 a timer determines the location of the trailing edge, times the stopping of the mandrel drive motor 52, and a fastening means 130 may apply a fastener to fasten the trailing edge to the roll R. At that time the cylinder 64, 68 that has not been deactuated is deactivated to move the respective guide plate 56, 58 to the inoperative open position removed from the mandrel. A pair of proximity switches 116, 118 sense the open positions of both plates and trigger actuation of the cradle support cylinder 96 to raise the support cradle 84 and a support cradle home position proximity switch 119 beneath the arm 88 triggers deactuation of the mandrel end support arm cylinder 76. When the arm 74 has been raised to the upper non-supporting position, a proximity switch 120 adjacent the normal arm support position provides a signal to commence operation of the band cylinder 108 to effect movement of the pusher plate 98 to start to discharge the wound roll from the mandrel. When the pusher plate 98 reaches a position adjacent the cradle 84, a proximity switch 122 on the beam 78 senses the position of the legs 101, 102 of the pusher system and provides a signal to deactuate the cylinder 96, and when the pusher plate has moved to the end of its stroke and the roll has been discharged, an end of stroke proximity switch 124 on the beam 78 senses this action and triggers actuation of the support arm cylinder 76 to return the arm 74 to the support position and thereafter returns the band cylinder 108 to its home position. A pusher plate home proximity switch 126 senses when the plate 98 is in the home position and effects actuation of the guide arm cylinders 64 and 68 to position the plates 56, 58 to the operative guiding position and also effects the movement of the mandrel drive motor to position the slot 54 to the leading edge receiving position, a proximity switch 128 acting to sense disposition of a lobe on the mandrel and thus of the slot and to control the motor 52. All of the components have then been restored to the initial position and the winding cycle may then again commence. Conventional fastening means 130 adjacent the roll wound on the mandrel may apply fasteners or the like to the rug prior to commencing of the discharge process.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A web winding machine comprising an axially extending substantially cylindrical hollow mandrel about which a web of material is to be wound into a roll and thereafter discharged, said mandrel having a driven end and a web discharge end remote from said driven end, bearing means supporting said mandrel at said driven end, motor means at said driven end for rotatably driving said mandrel about an axis of rotation to wind said web thereon into a roll, removable end support means for supporting said discharge end of said mandrel at least while said web is being wound into said roll and removable from said discharge end to permit said roll to be removed from said discharge end, end support actuation means for moving said end support means selectively into and out of supporting relationship with said discharge end, pusher means movable in a direction substantially parallel to said axis of rotation from said driven end toward said discharge end for engaging said roll after it has been wound and pushing said roll off said mandrel after said support means has been removed from said discharge end, a support carriage adjacent said discharge end movable selectively into a roll supporting position for supporting said roll while on said mandrel and into a stowed position displaced from said roll, and carriage actuation means for moving said carriage into disposition for supporting said roll after said roll has been formed and prior to and after removal of said end support means from said discharge end, whereby said roll and thus said mandrel remains supported adjacent each end.

2. A web winding machine as recited in claim 1, wherein said carriage includes a roller disposed for abutting said roll when said carriage is in said roll supporting position, and means for journally mounting said roller for rotation about an axis offset from and transverse to said axis of rotation of said mandrel.

3. A web winding machine as recited in claim 2, wherein said roller is disposed below said mandrel.

4. A web winding machine as recited in claim 1, wherein said carriage comprises lever means journalled for movement about a pivot axis, a roller carried by said lever means spaced from said pivot axis, means for journally mounting said roller for rotation about an axis parallel to said pivot axis offset from and transverse to said axis of rotation of said mandrel, and means for connecting said lever means to said carriage actuation means to pivot said lever means about said pivot axis selectively in a first direction to abut said roller with said roll and in a second direction opposite to said first direction.

5. A web winding machine as recited in claim 1, wherein said pusher means comprises a pusher plate, pusher drive means for selectively pushing said plate against an end of said roll to move said roll, and a movable mandrel support member disposed in contact with and movable relatively to said mandrel carried by and movable with said plate for aiding support of said mandrel as said plate and said roll move toward said discharge end.

6. A web winding machine as recited in claim 5, wherein said movable mandrel support member comprises a cylindrical member disposed about said mandrel.

7. A web winding machine as recited in claim 6, wherein said plate comprises an annular disk disposed about said mandrel.

8. A web winding machine as recited in claim 5, wherein said carriage includes a roller disposed for abutting said roll when said carriage is in said roll supporting position, and means for journally mounting said roller for rotation about an axis offset from and transverse to said axis of rotation of said mandrel.

9. A web winding machine as recited in claim 8, wherein said roller is disposed below said mandrel.

10. A web winding machine as recited in claim 9, wherein said movable mandrel support member comprises a cylindrical member disposed about said mandrel.

11. A web winding machine as recited in claim 10, wherein said plate comprises an annular disk disposed about said mandrel.

12. A web winding machine as recited in claim 8, wherein said movable mandrel support member comprises a cylindrical member disposed about said mandrel.

13. A web winding machine as recited in claim 12, wherein said plate comprises an annular disk disposed about said mandrel.

14. A web winding machine as recited in claim 2, wherein said end support means comprises an arm pivotably mounted for movement about an axis parallel to the axis of rotation of said roller, a rotatable support member journally carried by said arm for abutting said discharge end of said mandrel to support said discharge end, and said end support actuation means comprising means for pivoting said arm.

15. A web winding machine as recited in claim 14, wherein said roller is disposed below said mandrel.

16. A web winding machine as recited in claim 15, wherein said pusher means comprises a pusher plate, pusher drive means for selectively pushing said plate against an end of said roll to move said roll, and a movable mandrel support member disposed in contact with and movable relatively to said mandrel carried by and movable with said plate for aiding support of said mandrel as said plate and said roll move toward said discharge end.

17. A web winding machine as recited in claim 16, wherein said movable mandrel support member comprises a cylindrical member disposed about said mandrel.

18. A web winding machine as recited in claim 17, wherein said plate comprises an annular disc disposed about said mandrel.

19. A web winding machine as recited in claim 4, wherein said end support means comprises an arm pivotably mounted for rotation about an axis parallel to said pivot axis, a rotatable support member journally carried by said arm for abutting said discharge end of said mandrel to support said discharge end, and said end support actuation means comprising means for pivoting said arm.

20. A web winding machine as recited in claim 19, wherein said pusher means comprises a pusher plate, pusher drive means for selectively pushing said plate against an end of said roll to move said roll, and a movable mandrel support member disposed in contact with and movable relatively to said mandrel carried by and movable with said plate for aiding support of said mandrel as said plate and said roll move toward said discharge end.

21. A web winding machine as recited in claim 20, wherein said movable mandrel support member comprises a cylindrical member disposed about said mandrel.

22. A web winding machine as recited in claim 21, wherein said plate comprises an annular disk disposed about said mandrel.

* * * * *